US007254319B2

(12) United States Patent
Bonnin et al.

(10) Patent No.: US 7,254,319 B2
(45) Date of Patent: Aug. 7, 2007

(54) HEATING SYSTEM COMPRISING AT LEAST TWO DIFFERENT RADIATIONS

(75) Inventors: Michelle Bonnin, Vandières (FR); Sylvain Chehu, Champigneulles (FR); Jean-Jacques Frey, Maidières (FR); Jérôme Martinache, Pont-A-Mousson (FR); Philippe Lucien Georges Poirson, Villers les Nancy (FR)

(73) Assignee: Koninklijke Philips Electronics, N.V., Eindhoven (NL)

( * ) Notice: Subject to any disclaimer, the term of this patent is extended or adjusted under 35 U.S.C. 154(b) by 75 days.

(21) Appl. No.: 10/536,245

(22) PCT Filed: Nov. 13, 2003

(86) PCT No.: PCT/IB03/05146

§ 371 (c)(1),
(2), (4) Date: May 24, 2005

(87) PCT Pub. No.: WO2004/049760

PCT Pub. Date: Jun. 10, 2004

(65) Prior Publication Data

US 2006/0051078 A1 Mar. 9, 2006

(30) Foreign Application Priority Data

Nov. 27, 2002 (FR) ..... 02 14900

(51) Int. Cl.
*F21V 7/00* (2006.01)

(52) U.S. Cl. ..... 392/423; 392/407

(58) Field of Classification Search ..... 392/411–426, 392/407; 250/495.1, 494.1, 504 R; 34/266, 34/270, 273, 275
See application file for complete search history.

(56) References Cited

U.S. PATENT DOCUMENTS

| | | | | | |
|---|---|---|---|---|---|
| 2,282,070 | A | * | 5/1942 | Mahannah | 34/660 |
| 2,346,234 | A | * | 4/1944 | Reynolds | 34/88 |
| 2,745,940 | A | * | 5/1956 | Stroh | 392/411 |
| 2,824,943 | A | * | 2/1958 | Laughlin | 219/411 |
| 3,953,100 | A | * | 4/1976 | Feeney | 439/206 |
| 4,266,117 | A | | 5/1981 | Pardue et al. | |
| 4,571,486 | A | * | 2/1986 | Arai et al. | 438/799 |
| 6,421,503 | B2 | | 7/2002 | Grob et al. | |
| 6,577,816 | B2 | * | 6/2003 | Grob et al. | 392/407 |
| 2002/0094197 | A1 | | 7/2002 | Grob et al. | |

FOREIGN PATENT DOCUMENTS

| | | | |
|---|---|---|---|
| JP | 64-65790 | * | 3/1989 |
| JP | 2-152187 | * | 6/1990 |
| JP | 8-107078 | * | 4/1996 |

* cited by examiner

*Primary Examiner*—Thor Campbell

(57) ABSTRACT

A heating system includes a reflector having a concave section symmetrical with respect to an axis of symmetry. In addition, a first radiation system having at least a first radiation member is capable of emitting a first type of radiation and a second radiation system having at least a second radiation member is capable of emitting a second type of radiation. The second radiation system is positioned in a direction parallel to the axis of symmetry with respect to the first radiation system.

24 Claims, 5 Drawing Sheets

HEATING SYSTEM COMPRISING AT LEAST TWO DIFFERENT RADIATIONS

FIELD OF THE INVENTION

The invention relates to a heating system comprising at least two radiation members capable of emitting at least two different types of radiation.

The invention finds its application, for example, in a heating system designed for industrial purposes such as curing of synthetic resins by heat, drying of paper, or baking of paints.

BACKGROUND OF THE INVENTION

U.S. Pat. No. 6,421,503 published Jul. 16, 2002 describes a heating system comprising two radiation members capable of emitting two different types of radiation. These radiation members are tubular in shape. The first radiation member comprises an incandescent filament capable of emitting a radiation in the near infrared range, whereas the second radiation member comprises a carbon ribbon capable of emitting a radiation in the medium infrared range.

It is a disadvantage of such a system that a given point of a coating under treatment is not simultaneously exposed to the two types of radiation. FIG. 1 is a cross-sectional view of such a heating system and of a coating treated by this heating system. The heating system shown in FIG. 1 corresponds to a heating system of FIG. 5 from U.S. Pat. No. 6,421,503. Such a heating system comprises a first radiation member 10 comprising a first quartz envelope 12 and a carbon ribbon 14, and a second radiation member 11 comprising a second quartz envelope 13 and an incandescent filament 15 kept in position by a support 15*a*. The two radiation members 10 and 11 are fixedly joined together by a central section 17. Each of the two radiation members 10 and 11 is covered with a reflecting layer 16 on an upper half of the respective quartz envelope 12 or 13.

Under these operating conditions, the radiation emitted by the first and the second radiation member 10 and 11 is necessarily downwardly directed when the heating system is arranged as shown in FIG. 1. Consequently, an object 18 to be treated by this heating system is present below said heating system. This object 18 comprises a coating 19 which is to be treated by the heating system. This may relate to, for example, a metal plate on which a paint comprising a pigment and a solvent has been deposited.

In such a configuration, the rays emitted by the radiation members 10 and 11 are not focused on the same location of the coating 19. As a result, the overlap of the two types of radiation, which is particularly advantageous in applications such as the drying of paints, is limited, i.e. the spectral combination of the spectra of the two types of radiation is limited.

In addition, the fact that the rays emitted by the radiation members 10 and 11 are not focused on the same location of the coating 19 leads to a prolonged treatment time for the coating 19, since each point of the coating 19 must be exposed to two types of radiation.

Another disadvantage of such a heating system is that the heating system is cumbersome. An oven for drying the coating will in fact generally comprise several heating systems arranged side by side, parallel to a direction in which the objects under treatment are moved. The dimensions of the heating system of FIG. 1 are important in view of this direction, because the heating system comprises two radiation members 10 and 11 arranged in this direction.

DESCRIPTION OF THE INVENTION

It is an object of the invention to provide a compact heating system giving an enhanced spectral combination.

To achieve this object, the invention provides a heating system comprising a reflector having a concave cross-section that is substantially symmetrical with respect to an axis of symmetry, a first radiation system comprising at least a first radiation member capable of emitting a first type of radiation and a second radiation system comprising at least a second radiation member capable of emitting a second type of radiation, said second radiation system being positioned in a direction substantially parallel to said axis of symmetry with respect to said first radiation system.

According to the invention, the radiation systems are arranged in a direction parallel to the axis of symmetry of a cross-section of the reflector with respect to one another, and not in a direction perpendicular to the axis of symmetry of a cross-section of the reflector, as in the prior art. In this manner the rays emitted by the two radiation systems are focused for a major portion onto a same region of the coating under treatment. The spectral combination of the different emitted radiation types is enhanced thereby. In addition, the radiation systems are superimposed in the direction of emission of the rays, which makes such a heating system compact.

Advantageously, the first radiation member comprises a first envelope and further comprises a first reflecting layer deposited on a portion of said first envelope. This renders it possible to improve the focusing of the radiation emitted by the first radiation member and accordingly to enhance the spectral combination of the emitted rays.

Advantageously, the second radiation member comprises a second envelope and further comprises a second reflecting layer deposited on a portion of said second envelope. This renders it possible to improve the focusing and to enhance the spectral combination of the emitted rays still further.

Preferably, the first reflecting layer has a first concave section that is substantially symmetrical with respect to a first axis of symmetry parallel to the axis of symmetry of the cross-section of the reflector, the second reflecting layer has a second concave section that is substantially symmetrical with respect to a second axis of symmetry parallel to the axis of symmetry of the cross-section of the reflector, and the first and second reflecting layers have mutually opposed directions of concavity and are adjacent to one another. Such a configuration renders possible in particular a thermal protection of the radiation members. Such a disposition of the reflecting layers renders it possible to protect each radiation member from the radiation emitted by the other radiation member. Such a thermal protection renders it possible to prolong the operational life of such a heating system.

Advantageously, the first radiation type is situated in the short infrared range, the second radiation type is situated in the medium infrared range, and the second radiation member is located between the reflector and the first radiation member. Such a configuration provides an even more enhanced spectral combination when these two types of radiation are used in such a heating system.

In an advantageous embodiment of the invention, the reflector is a first reflecting layer deposited on a portion of the envelope of the first radiation member. This renders it possible in particular to omit the use of an external reflector, which reduces the bulk of such a heating system.

Advantageously, the second radiation member comprises in addition a second reflecting layer deposited on a portion of the envelope of the second radiation member. This renders it possible to improve the focusing and to enhance the spectral combination of the emitted rays.

Preferably, the second reflecting layer has a concave section that is substantially symmetrical with respect to an axis of symmetry parallel to the axis of symmetry of the cross-section of the first reflecting layer, the first and second reflecting layers having mutually opposed directions of concavity and being mutually adjacent. Such a heating system provides in particular a thermal protection of the radiation members. Such a heating system is used by preference in combination with an external reflector, for example in an oven already fitted with reflectors. The heating system does not have an external reflector, so that is not necessary to remove an external reflector if the heating system is to be used in an oven fitted with a reflector.

Preferably, the reflecting layers used are ceramic layers. Such reflecting layers provide a good focusing of the radiation, are resistant to high operating temperatures of such a heating system, form good thermal protection means, and are easy to deposit on the radiation members.

Advantageously, the first and the second radiation member are kept in position by at least one cap in which an end of the first radiation member and an end of the second radiation member are inserted. It is not necessary in this manner to interconnect the radiation members permanently as is the case in the prior art. This renders possible in particular an easy exchange of one of the radiation members when it is defective.

BRIEF DESCRIPTION OF THE FIGURES

The invention will be better understood and further details will become apparent from the following description which is given with reference to the annexed drawings, which merely represent non-limitative examples and in which.

DETAILED DESCRIPTION OF AT LEAST ONE EMBODIMENT OF THE INVENTION

Figures 2A, 2B:
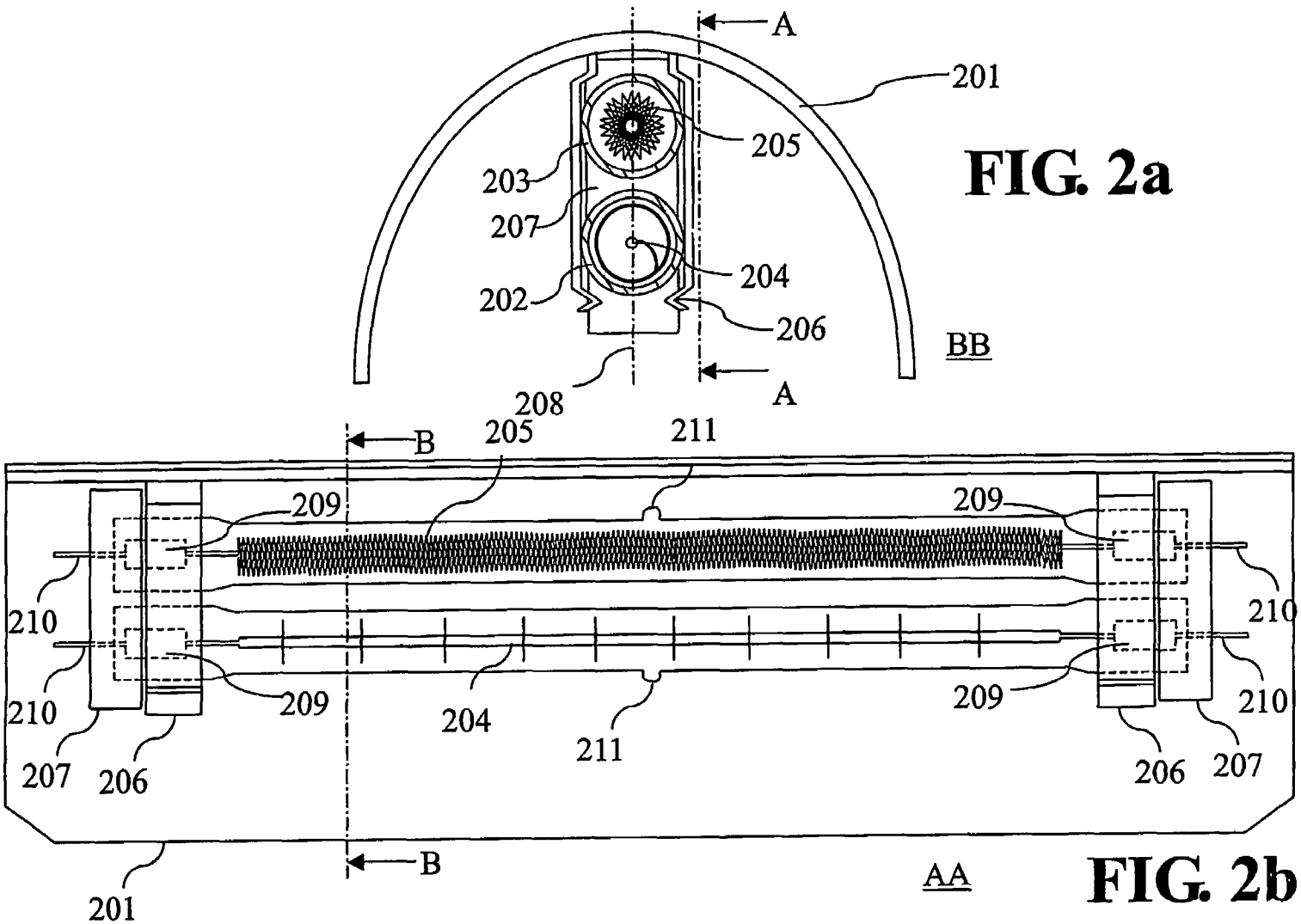
FIG. 2*a* is a cross-sectional view of a first heating system according to the invention.
FIG. 2*b* is a longitudinal sectional view of such a system.

FIGS. 2*a* and 2*b* show a first heating system according to the invention in cross-section and in longitudinal section, respectively. FIG. 2*b* corresponds to a section in a plane AA in FIG. 2*a*. FIG. 2*a* corresponds to a section in a plane BB in FIG. 2*b*. Such a heating system comprises an external reflector 201, a first radiation member 202 comprising an incandescent filament 204, a second radiation member 203 comprising a star-shaped filament 205, two supports 206, and two caps 207.

The first radiation member 202 in this example is a halogen tube capable of emitting in the short infrared range, denoted IR-A below, covering mainly the wavelengths lying between 0.78 and 1.4 microns. A definition of the wavelength has been given in 1987 by the International Electrotechnical Commission (IEC) in section 845-01 "Radiation, Quantities and Units". Such a radiation member 202 in the form of a halogen tube with an incandescent filament 204 is known to those skilled in the art. For example, applicant has made such a halogen tube commercially available under reference 13402Z. The incandescent filament 204 is supplied with current through external contacts 210 which are connected to molybdenum foils 209, on which two ends of the incandescent filament 204 are welded. The first radiation member 202 has an exhaust tube tip 211 which results from the filling of the halogen tube with a rare gas and halogen mixture during the manufacture of this tube.

The second radiation member 203 in this example is a halogen tube capable of emitting in the medium infrared range, denoted IR-B, comprising mainly wavelengths lying between 1.4 and 3 microns. Such a radiation member 203 in the form of a halogen tube with a star-shaped filament 205 is known to those skilled in the art. For example, applicant has made such a halogen tube commercially available under reference 17010Z, said tube being one from a range of lamps generally denoted "High-Speed Medium Wave". The second radiation member 203 comprises external contacts 210, molybdenum foils 209, and an exhaust tube tip 211, as does the first radiation member 202.

Alternative types of radiation members may obviously be used without departing from the scope of the invention. It is possible, for example, to use single-ended lamps, or also radiation members such as those described in U.S. Pat. No. 6,421,503.

The cross-section of the external reflector 201 shown in FIG. 2*a* is a concave section having an axis of symmetry 208. The first and the second radiation member 202 and 203 are positioned in a direction parallel to said axis of symmetry 208 with respect to one another. In the example shown in FIG. 2*a*, the axis of symmetry 208 of the external reflector 201 is shown in vertical position, so that the first and second radiation members 202 and 203 are positioned one above the other. This positioning causes the rays emitted by the first and the second radiation member 202 and 203 to be mainly focused onto one and the same region centered on the axis of symmetry 208. A major spectral combination is thus obtained at the level of said region. When an object is thus treated by such a heating system, for example for drying a coat of paint, a point of the object under treatment is simultaneously exposed to the two types of radiation. As a result, the processing time of the object is short, and the treatment is efficient. Furthermore, such a heating system is more compact than a heating system from the prior art, in which the radiation members are mutually positioned in a direction perpendicular to the axis of symmetry 208. This is particularly advantageous because it is necessary in an oven comprising a plurality of heating systems to reduce the space occupation in the direction of movement of the objects under treatment, i.e. a direction perpendicular to the axis of symmetry 208.

It is important to note here that according to the invention the radiation members 202 and 203 are not necessarily positioned on the axis of symmetry 208. The radiation members 202 and 203 may be positioned with respect to one another in a direction substantially parallel to the axis of symmetry 208, i.e. in a direction enclosing a small angle with the axis of symmetry, for example an angle smaller than 30°. In the example of FIG. 2*a*, the second radiation member 203 may thus be slightly shifted to the left or to the right with respect to the position in which it is shown, without departing from the spirit of the invention. In fact, such a slight shift will have little influence on the spectral combination obtained in a region of an object under treatment.

In the example of FIGS. 2*a* and 2*b*, the external reflector 201 has an elliptical shape, the first and the second radiation member 202 and 203 being positioned around a focus of said ellipse. Such an elliptical shape is particularly advantageous because it renders possible a good focusing of the rays emitted by the two radiation members 202 and 203. Moreover, the fact that radiation members of the halogen type are used is particularly advantageous because the rays emitted by such radiation members can be easily focused.

In the example of FIGS. 2*a* and 2*b*, the second radiation member 203 is positioned between the external reflector 201 and the first radiation member 202. Applicant has found that a better spectral combination is obtained thereby than if the first radiation member 202 were positioned between the external reflector 201 and the second radiation member 203, in the case in which the first radiation member 202 emits in the short infrared range and the second radiation member 203 in the medium infrared range.

The first and second radiation members 202 and 203 in this example are kept in position with respect to one another by two caps 207 in which the ends of the radiation members 202 and 203 are inserted. Advantageously, these caps 207 are ceramic caps, and the ends of the radiation members 202 and 203 are joined to the respective caps by means of cement. Obviously, alternative types of caps may be used, in particular caps having reversible fixation means for the ends of the radiation members, for example by means of a rapid joint of the R7s type. This provides an easy replacement of one of the radiation members when it is out of order. It is obviously possible to dispense with such caps, for example in that the radiation members 202 and 203 are joined integrally together by their central sections as described in U.S. Pat. No. 6,421,503. Such a solution, however, necessitates a delicate fusion step and prevents the replacement of one of the radiation members when it is defective.

In the example of FIGS. 2*a* and 2*b*, the first and the second radiation member 202 and 203 are kept in position with respect to the external reflector 201 by supports 206 which form part of said external reflector 201. Alternative types of fixation may obviously be envisaged for keeping the radiation members in position in the external reflector 201. It is to be noted that it is possible to dispense with the caps 207 or with a central fusion section by inserting the ends of the two radiation members 202 and 203 into the supports 206, in which case the radiation members 202 and 203 are not one integral whole. The supports 206 thus serve to ensure the positioning of the radiation members with respect to one another and their positioning with respect to the external reflector 201.

Figure 1:
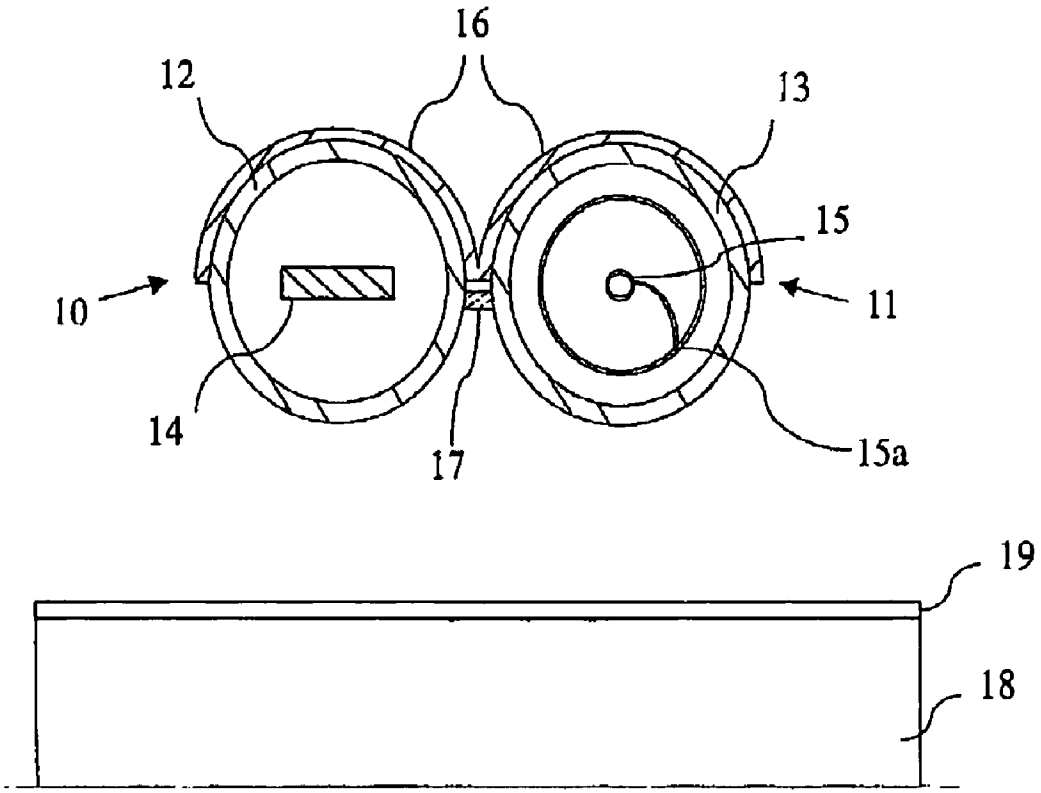
FIG. 1 (PRIOR ART)
FIG. 1 is a cross-sectional view of a heating system from the prior art.
Figures 3A, 3B:
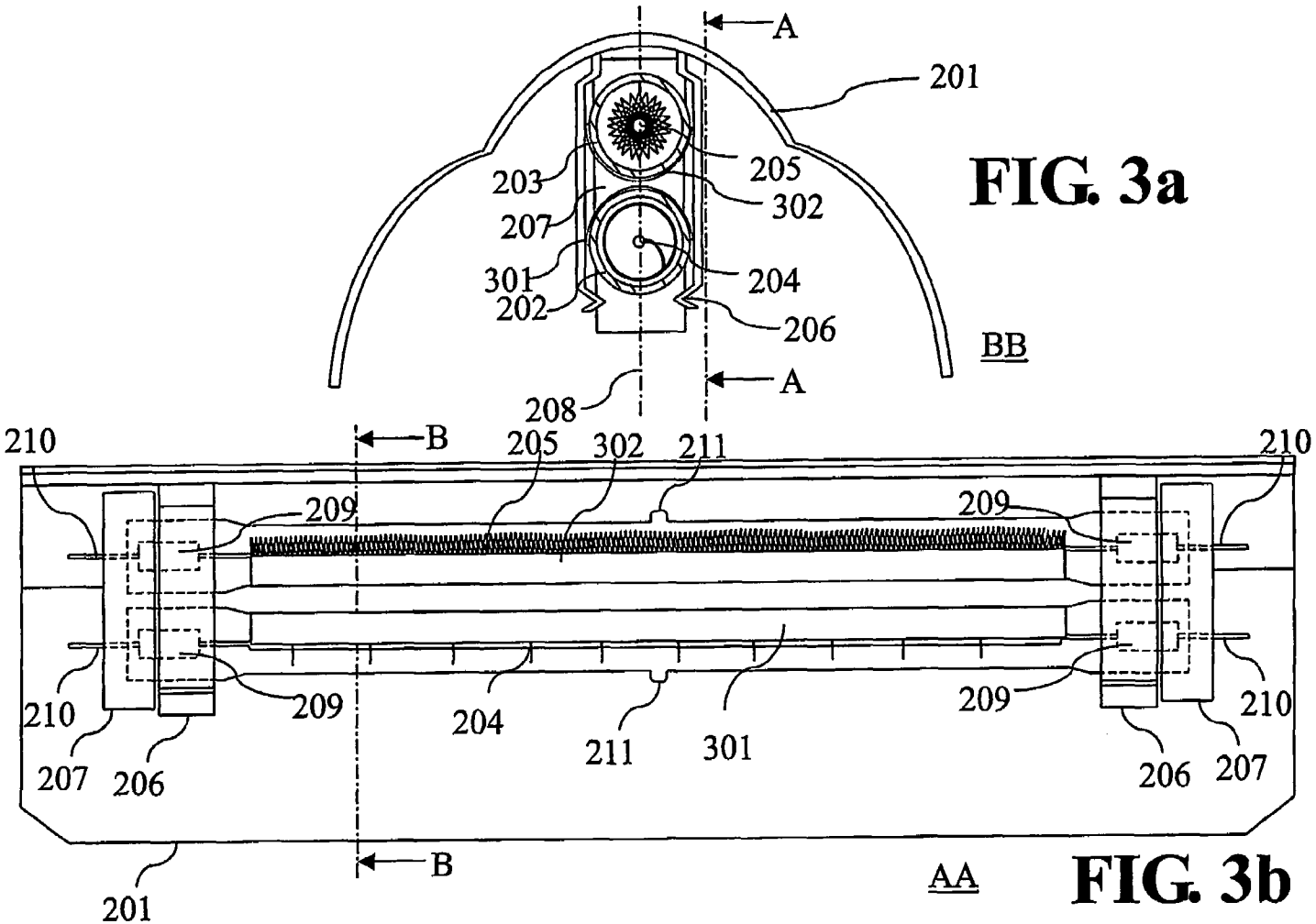
FIGS. 3*a* and 3*b* show a preferred embodiment of a heating system according to the invention, in cross-section and in longitudinal section, respectively.

FIGS. 3*a* and 3*b* show a heating system in a preferred embodiment of the invention in cross-section and in longitudinal section, respectively. This heating system comprises, in addition to the elements shown in FIG. 1, a first reflecting layer 301 and a second reflecting layer 302. The first and the second reflecting layer 301 and 302 have concave sections which are symmetrical with respect to the axis of symmetry 208. The first and the second reflecting layer 301 and 302 have mutually opposed concavities and are adjacent. The first reflecting layer 301 in this example is deposited on an upper portion of the first radiation member 202, and the second reflecting layer 302 is deposited on a lower portion of the second radiation member 203.

Such a heating system provides an improved focusing of the radiation emitted by the first and second radiation members 202 and 203, as well as an enhanced energy efficacy as compared with the heating system of FIGS. 2*a* and 2*b*. The radiation emitted in downward direction by the second radiation member 203 is in fact reflected by the second reflecting layer 302 before it is reflected by the external reflector 201 so as to reach an object under treatment arranged below the heating system. The radiation emitted in upward direction by the first radiation member 202 is directly reflected by the first reflecting layer 301 so as to reach the object under treatment. In this manner the major portion of the radiation emitted by the two radiation members 202 and 203 will reach the object under treatment and will be focused onto a region of the object, which region has a reduced surface area. The spectral combination is thus enhanced in this region, as is indeed the power level.

The reflecting layers used are known to those skilled in the art. They may be, for example, reflecting layers of gold. They may alternatively be reflecting layers of a ceramic material. Such a reflecting layer of ceramic material is used in particular in a halogen lamp made commercially available by applicant under reference 13185Z/98. It is to be noted that the reflecting layers 301 and 302 are very thin in relation to the thickness of the envelopes of the radiation members 202 and 203. For example, the thickness of a reflecting layer is of the order of 10 microns, whereas the thickness of the envelope of a radiation member is of the order of 1 mm. The thickness of the reflecting layers 301 and 302 in FIG. 3*a* is purposely exaggerated so that these two reflecting layers can be distinguished.

It is also to be noted that alternative configurations may be used in accordance with the invention. For example, a heating system may have a ceramic layer on only one of the radiation members, which provides an improved focusing, an improved spectral combination, and an improved power level compared with the heating system of FIGS. 2*a* and 2*b*.

In the example of FIGS. 3*a* and 3*b*, the reflecting layers 301 and 302 are ceramic layers and are deposited such that they provide a thermal protection for the radiation members 202 and 203. In fact, the radiation emitted by one of the radiation members will not reach the respective other radiation member directly, which leads to a lowering of the temperature of the radiation members 202 and 203 compared with the heating system of FIGS. 2*a* and 2*b*. This leads to a prolonged useful life of the radiation members 202 and 203.

In the example of FIGS. 3*a* and 3*b*, the external reflector 201 has two elliptical parts. The first radiation member 202 is centered on the focus of one of the two ellipses, the second radiation member 203 on the focus of the other ellipse. Such an external reflector 201 is particularly advantageous because it makes it possible to improve the focusing of the rays emitted by the radiation members 202 and 203.

Figures 4A, 4B:
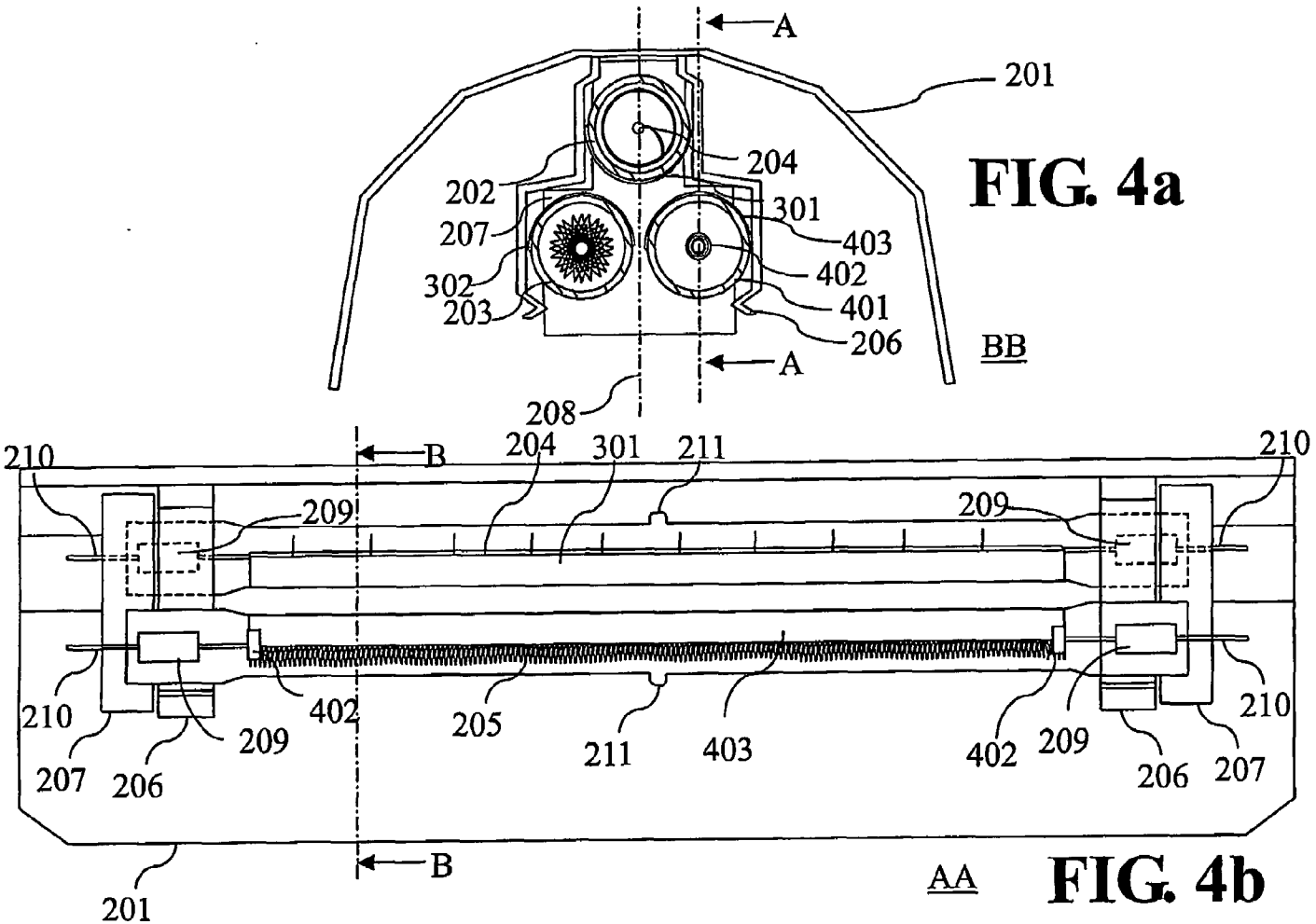
FIG. 4*a* is a cross-sectional view of a second heating system according to the invention.
FIG. 4*b* is a longitudinal sectional view of such a system.

FIGS. 4*a* and 4*b* show a second heating system according to the invention in cross-section and in longitudinal section, respectively. Such a heating system comprises, in addition to the elements shown in FIGS. 2*a*, 2*b*, 3*a*, and 3*b* above, a third radiation member 401. The first radiation member 202 forms a first radiation system. The second radiation member 203 and the third radiation member 401 form a second radiation system. In this example, the second radiation system is situated below the first radiation system.

The invention is obviously not limited to these radiation systems. For example, the invention may comprise a first radiation system comprising two radiation members and a second radiation system comprising two radiation members.

In the example of FIGS. 4*a* and 4*b*, the third radiation member 401 is a discharge lamp capable of emitting in the ultraviolet range. The third radiation member 401 comprises two electrodes 402 and is covered with a reflecting layer 403 on an upper portion of the envelope that constitutes the third radiation member 401. Such a third radiation member 401 is known to those skilled in the art. For example, a discharge tube capable of emitting in the ultraviolet range is described in U.S. Pat. No. 6,421,503.

Such a heating system renders it possible to obtain a wide spectrum of wavelengths at the level of a region of an object under treatment. It will be noted, however, that it is possible to treat an object with only one or two types of radiation at a time with such a heating system. It is possible, for example, to treat an object with a combination of radiation in the short infrared and medium infrared ranges, while the third radiation member 401 is not supplied with current. On the other hand, it is possible to treat an object with exclusively a radiation in the ultraviolet range. An advantage of such a heating system is that the system is compact and can be used in a large number of applications that require various spectra of wavelengths.

It is also to be noted that it is possible to vary the spectra of the radiation of the first and second radiation members 202 and 203 in dependence on the desired application in that the supply voltages for these radiation members are varied. This makes for an increase in the number of possible applications for such a heating system.

In the example of FIGS. 4*a* and 4*b*, the concave section of the external reflector 201 is composed of segments. Such an external reflector is easy to construct and renders it possible to obtain a good focusing of the radiation emitted by the two radiation systems.

If an external reflector of parabolic shape is used, such as the external reflector 201 of FIG. 2, it is advantageous to vary the respective positions of the radiation members 202, 203, and 401 as a function of the desired application. For example, if a drying process through radiation of medium infrared is carried out, it is advantageous to place the second radiation member 203 around the focus of the external reflector, i.e. in the location of the first radiation member 202. This may be effected in that the radiation members are rotated by means of, for example, a cap 207 capable of rotation with respect to the external reflector. The reflecting layers 301, 302, and 403 are advantageously positioned at 120° with respect to one another in this case.

Figure 5A:
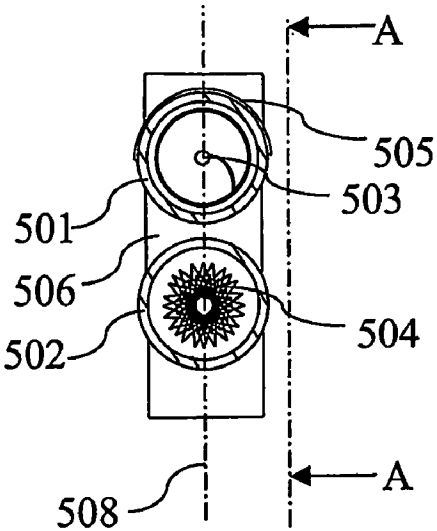
FIG. 5*a* is a cross-sectional view of a heating system in an advantageous embodiment of the invention.
Figure 5B:
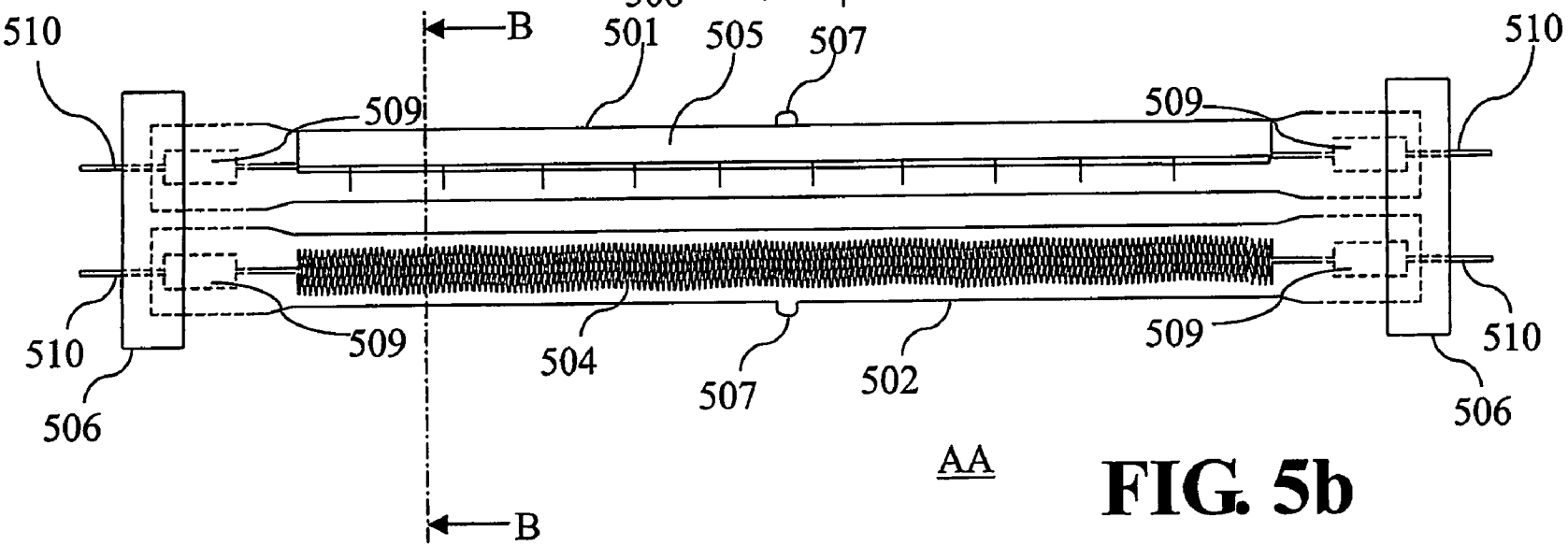
FIG. 5*b* is a longitudinal sectional view of such a system.

FIGS. 5*a* and 5*b* show a heating system in an advantageous embodiment of the invention in cross-section and in front elevation, respectively. This heating system comprises a first radiation member 501 comprising an incandescent filament 503 and a second radiation member 502 comprising a star-shaped filament 504. The first radiation member 501 comprises an envelope of which a portion is covered with a reflecting layer 505. This reflecting layer 505 comprises a concave section which is symmetrical with respect to an axis of symmetry 508. The radiation members 501 and 502 have exhaust tube tips 507, molybdenum foils 509, and external contacts 510. The radiation members 501 and 502 are kept in position with respect to one another by means of caps 506 in which the ends of the radiation members are accommodated.

The reflecting layer 505 in such a heating system performs the function of the external reflector 201 of FIGS. 2*a* and 2*b*. Such a heating system is accordingly particularly advantageous, because it is less bulky than the heating system of FIGS. 2*a* and 2*b*. Furthermore, such a system may be used in an oven that is already provided with a reflector.

The heating system in this advantageous embodiment of the invention is not limited to the individual embodiment shown in FIGS. 5*a* and 5*b*. For example, the second radiation member 502 may also comprise a reflecting layer. The first radiation member 501, for example, may comprise a reflecting layer on a lower half of its envelope, and the second radiation member 502 may have a reflecting layer on an upper half of its envelope. Such a system will be used to advantage with an external reflector such as the external reflector 201 of FIGS. 2*a* and 2*b*, but it may alternatively be autonomously used in an oven provided with, for example, reflecting walls.

The verb "comprise" and its conjugations should be given a wide interpretation, i.e. as not excluding the presence of elements other than those listed after said verb, and it is also possible for a plurality of elements to be present if listed after said verb and preceded by the article "a" or "an".

The invention claimed is:

1. A heating system comprising a reflector having a concave cross-section that is substantially symmetrical with respect to an axis of symmetry; a first radiation system comprising at least a first radiation member capable of emitting a first type of radiation, said first radiation member including a first reflecting layer; a second radiation system comprising at least a second radiation member capable of emitting a second type of radiation, said second radiation member including a second reflecting layer, and said second radiation system being positioned in a direction substantially parallel to said axis of symmetry with respect to said first radiation system; said first reflecting layer and said second reflecting layer having mutually opposed directions of concavity, wherein light from the first reflecting layer is not reflected into the second reflecting layer.

2. The heating system as claimed in claim 1, wherein said first radiation member comprises a first envelope, said first reflecting layer being deposited on a portion of said first envelope.

3. The heating system as claimed in claim 2, wherein said second radiation member comprises a second envelope, said second reflecting layer being deposited on a portion of said second envelope.

4. The heating system as claimed in claim 1, wherein said first reflecting layer has a first concave section that is substantially symmetrical with respect to a first axis of symmetry parallel to the axis of symmetry of the cross-section of the reflector, said second reflecting layer has a second concave section that is substantially symmetrical with respect to a second axis of symmetry parallel to the axis of symmetry of the cross-section of the reflector, and the first and the second reflecting layer are adjacent to one another.

5. The heating system as claimed in claim 1, wherein the first radiation type is situated in the short infrared range and the second radiation type is situated in the medium infrared range.

6. The heating system as claimed in claim 1, wherein the second radiation member is located between the reflector and the first radiation member.

7. The heating system as claimed in claim 1, wherein said first radiation member comprises a first envelope, and the first reflecting layer is deposited on a portion of said first envelope.

8. The heating system as claimed in claim 1, wherein said second radiation member comprises a second envelope, and said second reflecting layer is deposited on a portion of said second envelope.

9. The heating system as claimed in claim 1, wherein said second reflecting layer has a concave section that is substantially symmetrical with respect to an axis of symmetry parallel to the axis of symmetry of the cross-section of the first reflecting layer, the first reflecting layer and the second reflecting layer being mutually adjacent.

10. The heating system as claimed in claim 1, wherein the first reflecting layer and the second reflecting layer are ceramic layers.

11. The heating system as claimed in claim 1, wherein the first radiation member and the second radiation member are kept in position by at least one cap in which an end of the first radiation member and an end of the second radiation member are inserted.

12. A heating system comprising: a first radiation system including a first lamp partially surrounded by a first reflector; a second radiation system including a second lamp partially surrounded by a second reflector; wherein said first reflector and said second reflector have mutually opposed directions of concavity, wherein light from the first reflector is not reflected into the second reflector.

13. The heating system of claim 12, further comprising a system reflector surrounding said first lamp and said second lamp.

14. The heating system of claim 12, wherein said first reflector is located at a lower portion of said first lamp, and said second reflector is located at an upper portion of said second lamp.

15. The heating system of claim 14, wherein said lower portion and said upper portion being adjacent to each other.

16. The heating system of claim 13, wherein said system reflector, said first reflector and said second reflector are configured to focus light from said first lamp and said second lamp to substantially a same region.

17. The heating system of claim 16, wherein said first lamp is configured to provide a first radiation and said second lamp is configured to provide a second radiation which is different from said first radiation so that said same region is simultaneously exposed to said first radiation and said second radiation.

18. A heating system comprising: a system reflector, a first lamp partially surrounded by a first reflector; and a second lamp partially surrounded by a second reflector; wherein said first radiation and said second radiation first reflector and said second reflector have mutually opposed directions of concavity, wherein light from the first reflector is not reflected into the second reflector.

19. The heating system of claim 18, wherein said first lamp is configured to provide a first radiation which is different from a second radiation provided by said second lamp.

20. The heating system of claim 18, wherein said first lamp is located in a first plane and said second lamp located in a second plane, and wherein said first lamp and said second lamp are at least one of substantially aligned along an axis which is substantially perpendicular to said first plane and said second plane, and offset from said axis.

21. The heating system of claim 18, wherein said system reflector is configured to prevent direct radiation from said first lamp to said second lamp and from said second lamp to said first lamp.

22. The heating system of claim 18, wherein said system reflector include a first system reflector partially surrounding said first lamp, a second system reflector partially surrounding and said second lamp, and third system reflector partially surrounding said first lamp and said second lamp.

23. The heating system of claim 22, wherein said first system reflector is located at a lower portion of said first lamp, and said second system reflector is located at an upper portion of said second lamp.

24. The heating system of claim 18, wherein said first lamp and said second lamp are rotatable with respect to said system reflector.

* * * * *